US006206772B1

(12) United States Patent
Davis

(10) Patent No.: US 6,206,772 B1
(45) Date of Patent: Mar. 27, 2001

(54) DISC GRINDER

(76) Inventor: Glen A. Davis, 198 Riverbank La., Paso Robles, CA (US) 93446

( * ) Notice: Subject to any disclaimer, the term of this patent is extended or adjusted under 35 U.S.C. 154(b) by 0 days.

(21) Appl. No.: 09/366,431

(22) Filed: Aug. 2, 1999

(51) Int. Cl.[7] ..... B24B 41/06
(52) U.S. Cl. ..... 451/385; 451/386; 451/391
(58) Field of Search ..... 451/385, 386, 451/384, 378, 391, 365, 367; 269/249, 252, 253, 157, 3; 81/417, 427, 347, 355

(56) References Cited

U.S. PATENT DOCUMENTS 163,683 * 5/1875 Norton ..... 451/385
1,445,908 * 2/1923 Perkins ..... 81/347
2,551,648 * 5/1951 Suben ..... 51/237
3,934,316 * 1/1976 Driscoll ..... 24/243 CC
5,018,711 * 5/1991 Johnson ..... 269/43
5,860,197 * 1/1999 Fox ..... 24/522

* cited by examiner

*Primary Examiner*—Timothy V. Eley
*Assistant Examiner*—Dung Van Nguyen
(74) *Attorney, Agent, or Firm*—Daniel C. McKown

(57) ABSTRACT

A hand tool for holding a spinning disc while the circumference of the disc is being ground is noteworthy for its ability to accommodate disks of various thicknesses. The disc is gripped between two resilient grippers that rotate with the disc. The grippers are mounted for rotation to the jaws of the tool. The jaws slide open and closed on two spaced parallel guide pins that are parallel to the axes of rotation of the grippers. This assures that as the jaws are opened or closed to accommodate discs of different thicknesses, the axes of the grippers remain colinear.

1 Claim, 2 Drawing Sheets

FIG. 1 (PRIOR ART)
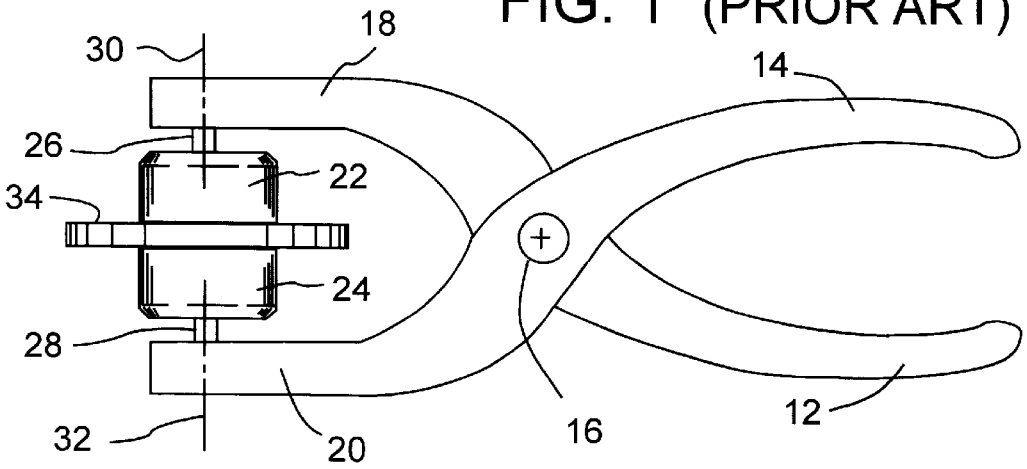
FIG. 2 (PRIOR ART)
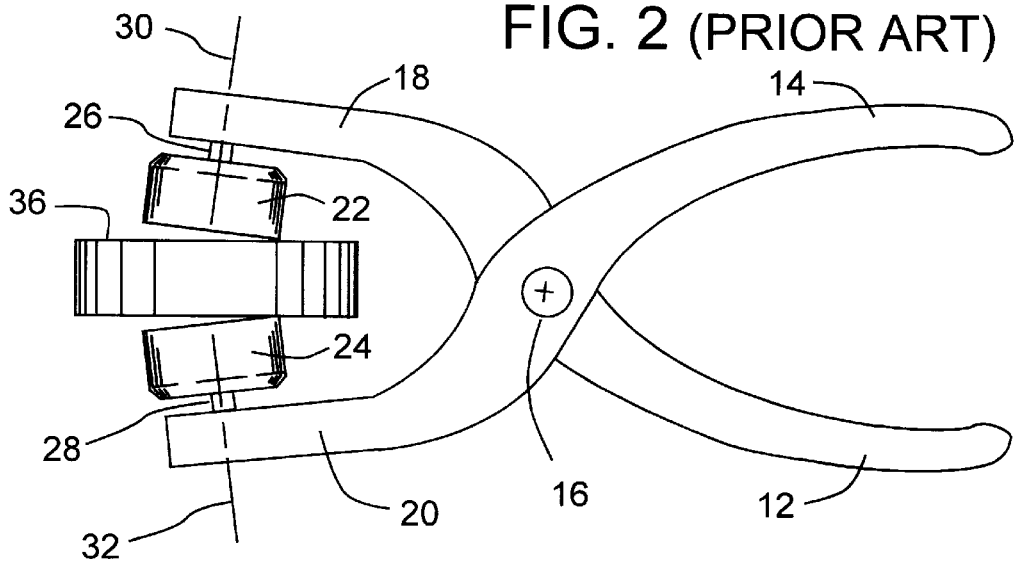
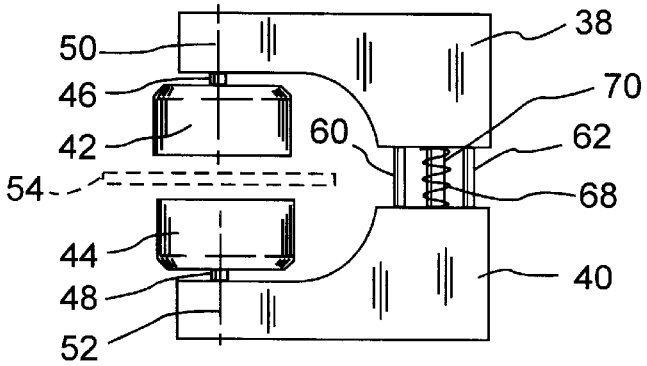
FIG. 3
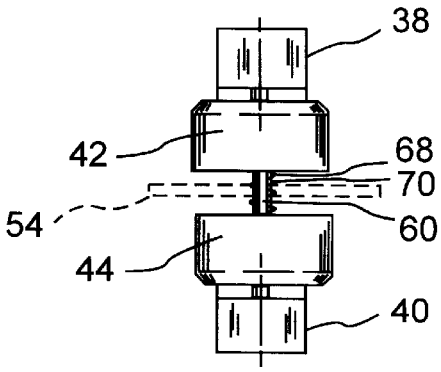
FIG. 4

DISC GRINDER

BACKGROUND OF THE INVENTION

1. Field of the Invention

The present invention is in the field of hand tools and more specifically relates to a hand tool for holding a disc while the circumference of the disc is being ground to produce a disc having a desired diameter.

2. The Prior Art

One way of producing a disc of a desired diameter is as follows. A number of disc-shaped blanks are punched from a sheet or plate of the chosen material. These blanks do not have the desired final diameter due to the fact that a punch of the right size may not be commercially available, and due to the lack of precision inherent in the punching process. In addition, the punched blanks may have burrs or irregular edges. The tool of the present invention is used for holding a punched blank while the circumferential edge of the blank is ground, to bring it to the desired diameter and to eliminate the burrs and irregularities.

In U.S. Pat. No. 163,683 issued May 25, 1875 to Norton, there is shown a clamp for use in grinding watch crystals. The crystal is held between elastic-faced grippers each of which rotates about an axis that is perpendicular to a jaw of the clamp. The jaws open and close by pivoting about a pin.

In U.S. Pat. No. 2,551,648 issued May 8, 1951, to Suben, there is shown a tool for use in beveling a lens. As in Norton's tool, the jaws are connected by a pivot. Also, a spring is used to urge the jaws closed. Each jaw terminates in a rotating gripper.

The tools of Norton and of Suben are designed for working with discs of a particular thickness. Because the jaws are connected by a pivot, as the jaws are opened to accommodate a thicker disc, the axes of the rotating grippers cannot remain in a single straight line. The elastic facing of the grippers can accommodate only relatively small variations of disc thickness. Larger variations in disc thickness disrupt the gripping action and may cause the disc to become dislodged.

With this problem in mind, the present inventor set out to design a disc grinder capable of being used with discs having a wide range of thicknesses.

SUMMARY OF THE INVENTION

The main object of the present invention is to provide a disc grinder that can, without adjustment, be used to grind discs that have a wide range of thicknesses.

In accordance with the present invention, the jaws open and close along a pair of parallel guide rods that assure that the axes of rotation of the grippers remain colinear as the jaws are opened and closed.

In a preferred embodiment, the jaws are biased to an open position, and the user squeezes the jaws closed by overcoming the biasing force.

In a alternative embodiment, a threaded member is rotated to draw the jaws together.

In all embodiments, the axes of the rotating grippers remain colinear as the jaws are opened and closed, thereby permitting the tool of the present invention to be used for grinding discs of various thicknesses.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and a description only and are not intended as a definition of the limits of the invention.

BRIEF DESCRIPTION OF THE DRAWINGS

FIG. 1 is a diagram showing a disc grinder of a type known in the prior art, in use;

FIG. 2 is a diagram showing the prior art disc grinder of FIG. 1 when a thicker disc is being ground;

FIG. 3 is a side elevational view showing a disc grinder in a preferred embodiment of the present invention;

FIG. 4 is a front end elevational view of the disc grinder of FIG. 3;

DETAILED DESCRIPTION OF THE PREFERRED EMBODIMENT

Figure 5:
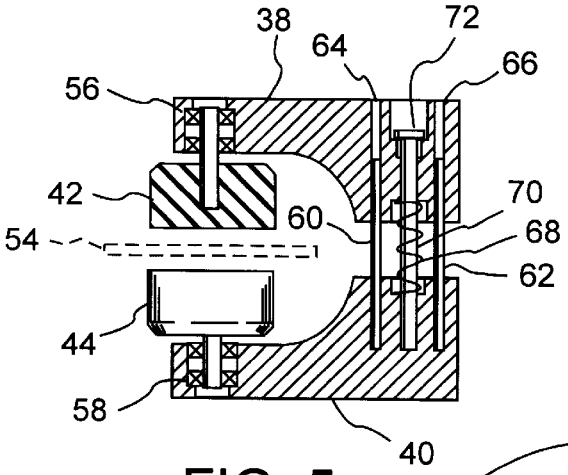
FIG. 5 is a side elevational view in cross section of the disc grinder of FIG. 3.

FIGS. 1 and 2 show a tool of a type known in the prior art, for grinding discs. The tool includes handles 12 and 14 which the user squeezes while the disc is being ground. Jaws 18 and 20 are pivotally connected through the pin 16. The tool includes resilient grippers 22 and 24, which are mounted for rotation about the axes 30 and 32 on the axles 26 and 28, respectively.

FIG. 1 shows the tool grasping a disc 34, and FIG. 2 shows the tool grasping a disc 36 that is thicker than the disc 34. In order to grasp the thicker disc 36, the jaws 18 and 20 must open wider, causing the axes 30 and 32 to depart in FIG. 2 from the colinear disposition shown in FIG. 1. This causes an irregular camping action which could cause the disc 36 to be ejected from the tool.

From consideration of FIGS. 1 and 2 it can be correctly seen that because the jaws are pivotally connected by the pin 16, the tool is limited to use on discs of a particular thickness, in the absence of some correcting mechanism.

For the ordinary mechanic who is not engaged in mass production, it does not make sense to purchase an assortment of tools in anticipation of a need to grind discs of various thicknesses. The present inventor recognized the desirability of having one tool capable of grinding discs of various thicknesses. As will be described in greater detail below, this objective was achieved by providing a mechanism for keeping the axes of the grippers in a colinear relationship as the jaws are opened and closed.

FIGS. 3, 4 and 5 show a preferred embodiment of the tool of the present invention.

In the preferred embodiment of FIGS. 3, 4 and 5, a disc 54 is positioned by the user between the grippers 42 and 44 in the position shown in the drawings, and then the jaws 38 and 40 are squeezed together by the user until the grippers 42, 44 firmly grip the disc. The disc 54 is not part of the invention, and is shown in dashed lines in the figures. The grippers 42 and 44 are affixed to axles 46 and 48 respectively which are mounted for rotation in the jaws 38 and 40 by use of the ball bearings 56 and 58, as shown in FIG. 5. The gripper 42 rotates about the axis 50 and the gripper 44 rotates about the axis 52.

The present inventor has succeeding in assuring that the axes 50 and 52 always lie in the same straight line regardless of the thickness of the disc 54. In accordance with the preferred embodiment of the present invention, this desirable result is accomplished by the use of two guide pins 60 and 62. In the preferred embodiment, the guide pins 60 and 62 are set into the jaw 40 by inserting the guide pins into tight-fitting bores in the jaw 40. The bores in the jaw 40 are extensions of the bores 64 and 66 that extend entirely through the jaw 38, as best seen in FIG. 5. However, the bores 64 and 66 in the jaw 38 have a slightly larger diameter than the bores in the jaw 40. This permits the jaw 38 to slide along the pins in a close sliding fit.

In one way of manufacturing the tool, the bores for the guide pins as well as the bores for the ball bearings are made in a single solid block of metal to assure alignment. Thereafter, the single block is sawed into two halves which become the jaws 38 and 40. In another way of making the tool, the jaws 38 and 40 are formed first and then clamped tightly together while the bores are made. Regardless of which technique is used, the axes 50 and 52 must be colinear, and they must be parallel to the guide pin bores in the jaw 40 and the bores 64 and 66 in the jaw 38. This assures that as the jaws 38 and 40 slide along the guide pins 60 and 62, the axes 50 and 52 will remain colinear.

In the preferred embodiment, the jaws 38 and 40 are biased apart by the compression spring 68 which is held captive on the rod 70. The rod 70 is provided with a head 72 that prevents the jaw 38 from being removed from the jaw 40.

Figure 6:
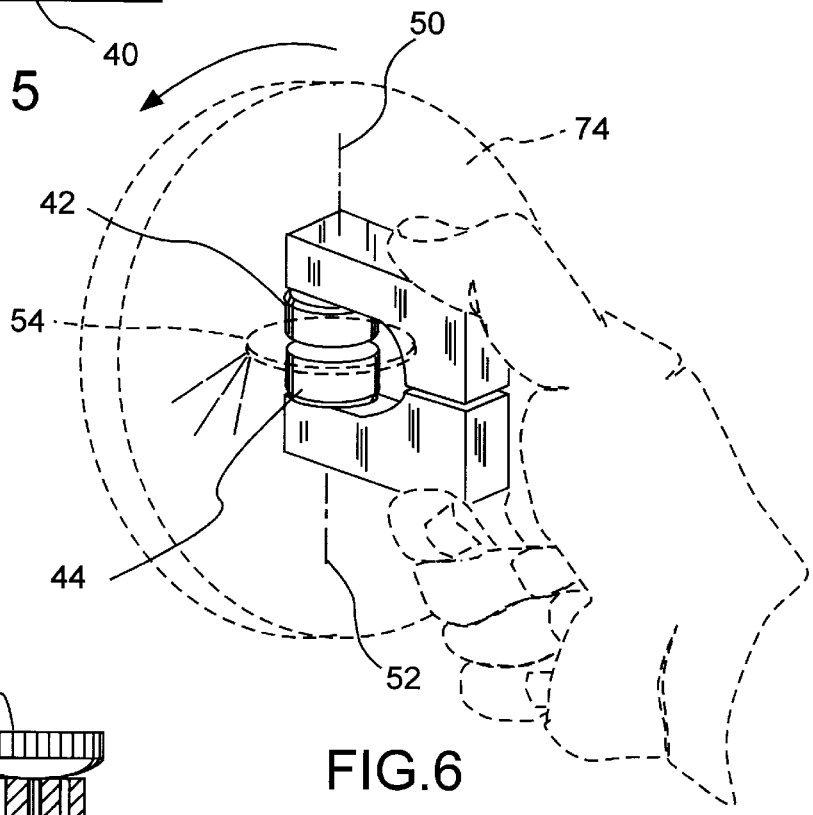
FIG. 6 is a perspective view of the disc grinder of FIGS. 3, 4 and 5 in use.

The embodiment of FIGS. 3, 4 and 5 is used in the manner shown in FIG. 6. The disc 54 is placed between the grippers 42 and 44 and is manually centered with the axes 50 and 52. Then, squeezing the jaws 38 and 40 between his thumb and forefinger, the user advances the tool toward the grinding wheel 74 until the disc 54 comes into contact with the grinding wheel 74.

Assuming that at the point of contact between the grinding wheel and the disc, the grinding wheel is moving vertically downward, it is clear that if the axis 50 is vertical, the disc will not spin. It is also seen that if the axis 50 is horizontal, the disc will spin rapidly. It has been found, as expected, that if the axis 50 is inclined slightly from the vertical the disc will spin at an intermediate speed. Thus, the user can control the speed with which the disc spins by slightly inclining the axis 50 with respect to vertical. In normal usage, the grinding wheel is spinning much more rapidly than the disc 54, but the spinning of the disc is highly desirable because it distributes the grinding action uniformly around the circumference of the disc, thereby preventing flat spots from developing.

Figure 7:
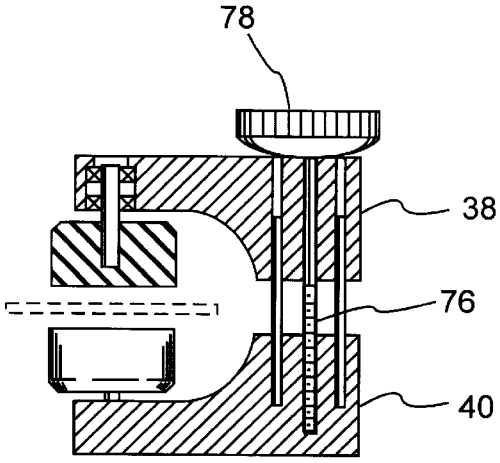
FIG. 7 is a side elevational view partly in cross section showing a disc grinder of an alternative embodiment.

FIG. 7 shows an alternative embodiment in which a lag screw 76 is used for opening and closing the jaws. The threads of the lag screw 76 engage threads in the jaw 40, and the smooth portion of the shank of the lag screw passes through a clearance bore in the jaw 38. The lag screw is provided with a large head 78 that is knurled on its circumference so that it can easily be turned.

Thus, there has been described a disc grinding hand tool that is capable of holding discs of various thicknesses during the grinding process. This is made possible by providing two pins that are affixed to one of the jaws in a direction parallel to the spin axis of the disc, and on which the other jaw slides.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A hand tool for holding a disc while the edge of the disc is being ground, comprising:

a lower jaw;

a lower gripper mounted to said lower jaw for rotation about a lower gripper axis;

a first ball bearing connecting said lower gripper to said lower jaw;

a first pin affixed to said lower jaw and extending from said lower jaw in a direction parallel to the lower gripper axis;

a second pin affixed to said lower jaw, spaced from said first pin and extending from said lower jaw in a direction parallel to the lower gripper axis;

an upper jaw, an upper gripper mounted to said upper jaw for rotation about an upper gripper axis;

a second ball bearing connecting said upper gripper to said upper jaw;

a first bore extending into said upper jaw in a direction parallel to the upper gripper axis and adapted to slidingly receive said first pin; and, a second bore spaced from said first bore and extending into said upper jaw in a direction parallel to the upper gripper axis, said second bore adapted to slidingly receive said second pin;

said lower gripper axis, said first pin and said second pin spaced to register respectively with said upper gripper axis, said first bore and said second bore when said first pin and said second pin are inserted into said first bore and said second bore respectively;

whereby, said lower gripper axis and said upper gripper axis remain collinear as said first and second pins slide within said first and second bores.

* * * * *